US011528569B2

(12) United States Patent
Rudrawal et al.

(10) Patent No.: US 11,528,569 B2
(45) Date of Patent: Dec. 13, 2022

(54) METHOD FOR TRANSMITTING INFORMATION FOR ADAPTING A HEARING AID AND NETWORKED COMPUTER INFRASTRUCTURE

(71) Applicant: Sivantos Pte. Ltd., Singapore (SG)

(72) Inventors: Sanjay Kumar Rudrawal, Banglore (IN); Balakrishnan Athmanathan, Banglore (IN); Stefan Aschoff, Eckental (DE)

(73) Assignee: SIVANTOS PTE. LTD., Singapore (SG)

( * ) Notice: Subject to any disclaimer, the term of this patent is extended or adjusted under 35 U.S.C. 154(b) by 66 days.

(21) Appl. No.: 17/128,438

(22) Filed: Dec. 21, 2020

(65) Prior Publication Data

US 2021/0112352 A1 Apr. 15, 2021

Related U.S. Application Data

(63) Continuation of application No. PCT/EP2018/066508, filed on Jun. 21, 2018.

(51) Int. Cl.
*H04R 25/00* (2006.01)

(52) U.S. Cl.
CPC ..... *H04R 25/70* (2013.01); *H04R 2225/55* (2013.01)

(58) Field of Classification Search
CPC ..... G10L 25/78; H04R 25/70; H04R 25/406; H04R 25/407; H04R 25/505; H04R 2225/41; H04R 2225/43; H04R 2225/55
See application file for complete search history.

(56) References Cited

U.S. PATENT DOCUMENTS

| | | | | |
|---|---|---|---|---|
| 6,058,197 | A * | 5/2000 | Delage | H04R 25/70 381/314 |
| 9,838,829 | B2 * | 12/2017 | El-Hoiydi | H04L 1/1657 |
| 2015/0023512 | A1 | 1/2015 | Shennib | |

FOREIGN PATENT DOCUMENTS

| | | | | |
|---|---|---|---|---|
| EP | 1628503 | A2 | 2/2006 | |
| JP | 2000287299 | A | 10/2000 | |
| WO | 2011128462 | A2 | 10/2011 | |
| WO | 2011147998 | A2 | 12/2011 | |
| WO | WO-2011147998 | A2 * | 12/2011 | H04M 3/523 |
| WO | 2013020594 | A1 | 2/2013 | |

* cited by examiner

*Primary Examiner* — Brian Ensey
(74) *Attorney, Agent, or Firm* — Laurence A. Greenberg; Werner H. Stemer; Ralph E. Locher

(57) ABSTRACT

A method for transmitting information for adapting a hearing aid, in which an inquiry with regard to information of a partial process of the adaptation and/or a partial process of an operation of the hearing aid is transmitted by a first participant to a networked computer infrastructure. The inquiry is checked for conformity by the networked computer infrastructure with a plurality of stored partial process instructions. In the event that conformity with the inquiry is ascertained the corresponding partial process instruction is output to the first participant. In the event that no conformity of one of the stored partial process instructions with the inquiry is ascertained, the inquiry is output to a second participant, a partial process instruction corresponding to the inquiry is created with the co-operation of the second participant, and the partial process instruction corresponding to the inquiry is output to the first participant.

10 Claims, 1 Drawing Sheet

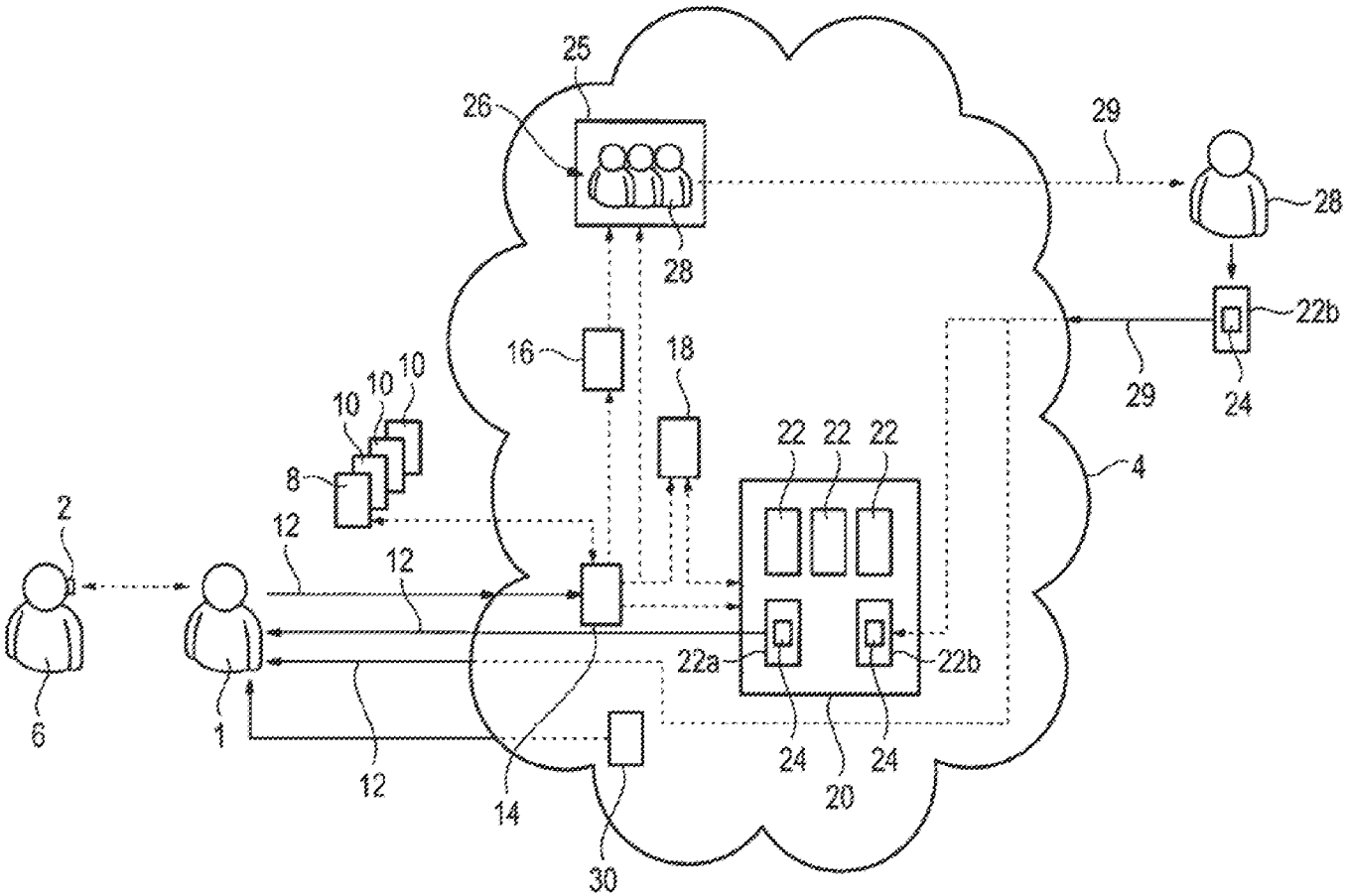
28
22b
24
29
29
4
22
22
22
22b
24
24
20
22a
28
18
25
26
16
14
30
10
10
10
8
12
12
12
1
2
6

METHOD FOR TRANSMITTING INFORMATION FOR ADAPTING A HEARING AID AND NETWORKED COMPUTER INFRASTRUCTURE

CROSS-REFERENCE TO RELATED APPLICATION

This application is a continuation, under 35 U.S.C. § 120, of copending international application No. PCT/EP2018/066508, filed Jun. 21, 2018, which designated the United States.

BACKGROUND OF THE INVENTION

Field of the Invention

The invention relates to a method for transmitting information for adapting a hearing aid by use of a networked computer infrastructure.

Hearing aids are usually used to compensate for or correct for a hearing impairment or more generally, a hearing loss. Although different manifestations of hearing loss can be grouped into individual medical diagnostic groups depending on their similarity, hearing loss is an individual phenomenon, so that in order to correct or compensate for the hearing loss a hearing aid must be adapted to the specific, individual manifestation of the hearing loss as currently suffered by the hearing aid user. In addition, a change in the hearing capacity of the user over time, for example if the hearing capacity in certain frequency bands continues to decrease over a certain period of time, may necessitate a fresh adaptation of the hearing aid, in particular of its signal processing settings. In particular, audiometric data are provided during the adaptation, which supply information about the user's specific, individual hearing loss, so that the parameters of the hearing aid can be adapted in an appropriate audiological adaptation application, taking these audiometric data into account.

Ideally, the hearing aid is adapted by an appropriately trained audiologist or hearing aid acoustician. However, especially in developing countries, the ratio of hearing aid users to hearing aid acousticians or audiologists is so high that a hearing aid user often visits a medical clinic or similar health center, the staff of which has appropriate knowledge of medical techniques but has no special audiological training. In most cases, the medical-technical staff in such a clinic therefore carry out the adaptation to the extent permitted by their own level of knowledge. Even if this can usually lead to reasonably useful results for the hearing aid user with regard to a basic usability of the hearing aid, situations often arise in which the medical-technical staff is dependent on information or help from a trained audiologist.

At present, however, there is no provision for an audiologist's intervention in the adaptation or even in questions concerning the operation of the hearing aid, such as an optimal choice of the specific hearing aid for the intended user, or possible operating durations. Consultations made via the telephone or via video communication often fail due to the lack of availability of an audiologist, and possibly also the stability of the data links for real-time video communication.

BRIEF SUMMARY OF THE INVENTION

The object of the invention is therefore to specify as simple a method as possible for transmitting information for an adaptation of a hearing aid, which allows the transmission of sub-process instructions for the adaptation in response to a specific request in as much detail as possible, and which is also as robust as possible against problems in the actual transmission of the sub-process instructions.

The aforementioned object is achieved according to the invention by a method for transmitting information for an adaptation of a hearing aid. A request concerning information of a sub-process of the adaptation and/or a sub-process of an operation of the hearing aid is transmitted by a first participant to a networked computer infrastructure. The request is checked by the networked computer infrastructure for compatibility with a plurality of stored sub-process instructions, and in the event that compatibility with the request is ascertained the corresponding sub-process instruction is output to the first participant. In the event that no compatibility of any of the stored sub-process instructions with the request is ascertained, the request is output to a second participant, a sub-process instruction corresponding to the request is created with the co-operation of the second participant, and the sub-process instruction corresponding to the request is output to the first participant. Advantageous embodiments, some of which are inventive in themselves, are the subject matter of the dependent claims and the following description.

A request concerning information about a sub-process of the adaptation contains, in particular, a request for specific instructions relating to the sub-process. The request essentially represents a description of a specific problem which can be solved by equally specific instructions. Similarly, the request may also relate to the sub-process in a "generic way", for example, with regard to any problems that may occur during the sub-process, so that the relevant instructions include the nature and scope of these potential problems, and, where appropriate, additional information on how these problems can be identified and how they might be avoided.

A sub-process of an operation of the hearing aid contains in particular all processes that can occur during normal operation after a proper adaptation of the hearing aid, in particular processes that involve the insertion or replacement of a battery of the hearing aid, or else the selection or adjustment of certain program modes of the hearing aid.

A networked computer infrastructure is understood to mean, in particular, a system which provides computing power and/or storage space and/or data-specific applications for data stored on the storage space for execution by means of the computing power provided. Access to the computing power and/or the storage space and/or the applications can be decentralized via the networking, which means it can be carried out from a plurality of access points. In particular, this will therefore include a cloud service.

In particular, the first participant includes a person who has to adapt a hearing aid, i.e. a user of a hearing aid him/herself or a person trusted by the user, or else personnel trained in general medical techniques without specific audiological training, but also an audiologist.

A plurality of sub-process instructions, in particular stored in the networked computer infrastructure, covers in particular the corresponding files, i.e. text, and/or audio, and/or video files, in which the sub-process instructions are represented in the relevant file format and can be reproduced. In particular, a check to ensure compatibility of the request with the stored sub-process instructions therefore includes the fact that a sub-process identified as the subject of the request is also identified in one of the stored files with the relevant sub-process instructions as the subject of the relevant file. Such a check can preferably be carried out by identifying a number of key terms in the request, wherein the key terms are stored in the networked computer infrastructure in a corresponding catalog database.

The check is preferably carried out in two stages, i.e., one or more of the key terms stored in the database are first identified in the request and these key terms are assigned to a specific sub-process, or a ranking of possible sub-processes is identified hierarchically based on the key terms. Then, from the plurality of stored sub-process instructions, the instruction corresponding to the identified sub-process or to the first sub-process in the ranking is identified as a file, and in the event of compatibility being ascertained, the corresponding file with the sub-process instruction is output to the first participant.

In particular, the case where no compatibility with any of the stored sub-process instructions with the request is ascertained can occur when no sub-process instruction is stored, to which all or a sufficient number of key terms identified in the request are assigned. In this case, the request will be output to a second participant, wherein, in particular, the second participant may be a person with a sufficiently high level of expertise in the field of adapting hearing aids, i.e. preferably an audiologist or a hearing aid acoustician.

The creation of a sub-process instruction corresponding to the request by co-operation of the second participant contains, in particular, the fact that the second participant—if necessary by means of text, data or multimedia material stored in the networked computer infrastructure—creates a text and/or multimedia file (i.e. an image, and/or audio, and/or video file) in which the sub-process instruction required by the request is represented according to the format. For example, for this purpose the second participant can record a video file explaining the instructions for the sub-process relating to the request, which may include occasionally explaining specific details of the sub-process using screenshots that illustrate an adaptation software or audiograms, for example. Finally, the multimedia file created in this way, which contains the sub-process instruction, is output to the first participant. For the relevant communication processes in the method, both the first participant and the second participant are preferably connected to the networked computer infrastructure via a respective data link for the appropriate time, preferably at a corresponding access point in each case.

The advantage of the method is that any given first participant from a plurality of potential interested parties can access the networked computer infrastructure in a decentralized manner from their workplace or location, and thus does not need to visit the second participant personally for the sub-process instruction corresponding to his/her request. The second participant can also be at any location and access the networked computer infrastructure accordingly. This also increases the choice of available participants as second participants, which means that a first participant has less waiting time on average for a sub-process instruction corresponding to his/her request. In addition, the sub-process instruction corresponding to the request can also be created semi-automatically by the co-operation of the second participant, for example by recording the sub-process performed by the second participant him/herself on his/her screen or using a camera.

Preferably, in the event that no compatibility of any of the stored sub-process instructions with the request is ascertained, the sub-process instruction corresponding to the request and created with the co-operation of the second participant is additionally stored in the networked computer infrastructure permanently. When the method is subsequently carried out by a person other than the first participant, this new first participant therefore has access immediately to the sub-process instructions created and stored in the networked computer infrastructure, and no longer has to wait for them to be created.

Conveniently, a plurality of available participants are registered in the networked computer infrastructure, the second participant being selected from the plurality of available participants. This means in particular that at the time of the request by the first participant the second participant does not necessarily have to be fixed, but rather is selected on the basis of a suitable criterion, such as their connection status with the networked computer infrastructure, or else dynamically depending on the request itself.

Advantageously, upon the transmission of the first request to the networked computer infrastructure by the first participant, an identifier is generated which contains characteristic information about the first participant for identifying him/her, and/or characteristic information regarding the requested sub-process of the adaptation. By associating the request with such an identifier, in particular in the case where the associated sub-process instruction must first be created by a second participant, this sub-process instruction can be output to the first participant in a targeted manner in the networked computer infrastructure. Characteristic information regarding the requested sub-process in the identifier is also advantageous if the created sub-process instruction is permanently stored in the networked computer infrastructure. In particular, the characteristic information for the identification of the first participant can comprise a name and/or an address as well as a unique participant ID based on these data.

The second participant is preferably selected from the plurality of available participants on the basis of the characteristic information with regard to the requested sub-process of the adaptation. This allows a second participant to be used for creating the requested sub-process instruction, one who has a special expertise with regard to this particular sub-process. The specific technical expertise is also recorded as part of the registration of the available participants.

Conveniently, the sub-process instruction corresponding to the request is output to the first participant on the basis of the identifier. In particular, this means that a file containing the corresponding sub-process instruction is transported to the access point to which the first participant is connected in the networked computer infrastructure, based on the identifier. In addition, the identifier can be used to check the reception authorization of the first participant before issuing the instruction, to be able to comply with data protection requirements, for example.

It has also proved advantageous if, in the event that a sub-process instruction corresponding to the request is generated by co-operation of the second participant, before the sub-process instruction is issued to the first participant an, in particular self-generated, output notification is transmitted to the first participant by the networked computer infrastructure. Preferably, the notification can also be routed to the first participant based on the identifier generated by the request. The output notification allows the first participant to actively download a corresponding file containing the sub-process instruction, for example by confirming the output notification or similar. This means that in the networked computer infrastructure, the specified file does not need to be made permanently available at the access point at which the first participant is connected to the networked computer infrastructure, which increases efficiency.

As information about the sub-process of the operation, information is requested about a possible duration of use of the hearing aid and/or about a replacement or insertion of a battery of the hearing aid and/or about a selection of a mechanical setup of the hearing aid. A mechanical setup of the hearing aid here contains, in particular, a selection of the form and/or type of the hearing aid for a specific form of hearing loss, and a mechanical adaptation of the hearing aid to the user's auditory canal.

As information about a sub-process of the adaptation, information is preferably requested about a possible progression of a hearing loss and/or about an adaptation of at least one parameter of the hearing aid to a past progression of a hearing loss. A possible progression of a hearing loss also comprises, in particular, a future progression with or without a hearing aid and possibly in accordance with the adaptation measures performed. A past development of a hearing loss contains, in particular, the current status of the hearing loss as a result of the past progression as well as an adaptation according to the past temporal progression.

The sub-process instruction corresponding to the request is advantageously output as a multimedia file, i.e. in particular as an image file and/or a video file and/or an audio file. This allows a particularly detailed description of the requested sub-process instruction for the first participant.

The invention further specifies a networked computing infrastructure having a memory for a plurality of sub-process instructions, with a first access point for entering a request and issuing a response, with a second access point for issuing a request and entering a sub-process instruction, and with a control unit for controlling and processing the communication between the first and second access points and the memory. The networked computing infrastructure is configured to carry out the prescribed method. The control unit is implemented in particular as a computer and/or a processor and/or a computing unit in the broadest sense. The advantages specified for the method and for its extensions can be transferred mutatis mutandis to the networked computer infrastructure.

Other features which are considered as characteristic for the invention are set forth in the appended claims.

Although the invention is illustrated and described herein as embodied in a method for transmitting information for adapting a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The sole FIGURE is a schematic block diagram of a method for transmitting information for adapting a hearing aid according to the invention.

DETAILED DESCRIPTION OF THE INVENTION

Referring now to the sole FIGURE of the drawing in detail, there is shown a schematic block diagram of a method by means of which a first participant 1 can obtain information concerning the adaptation of a hearing aid 2 using a networked computer infrastructure 4. The first participant 1 is a medical-technical staff member without specific audiological training, for example a medical-technical assistant or a nurse. The first participant 1 now performs the adaptation of the hearing aid 2 for a user 6 of the hearing aid 2. In particular, this includes collecting audiometric data on the hearing capacity and, where appropriate, on a hearing loss of the user 6 and using these data to change the corresponding settings for a signal processor in the hearing aid 2 according to the requirements of the user 6. Furthermore, the adaptation process also includes a mechanical adaptation of the hearing aid 2 to an ear of the user 6, and in particular to the auditory canal, for example by the correct selection of an acoustic coupling piece (such as an earmold) and, if necessary, an additional, individual adaptation of the shape of the acoustic coupling piece.

If the first participant 1 now has a specific question regarding a sub-process 8 of the adaptation, as may relate, for example, to the described individual shape of the acoustic coupling piece or else to matching a specific parameter in the signal processing of the hearing device 2 to the corresponding audiometric data of the user 6, without an answer to which the participant cannot continue the adaptation at least in this sub-process 8 and possibly in further sub-processes 10 which depend on the sub-process 8, he/she can obtain information regarding the sub-process 8 via the networked computer infrastructure 4 in the manner described below.

The networked computing infrastructure 4 is provided in this case by a cloud service. The first participant 1 now transmits a request 14 concerning the sub-process 8 via a data link 12, which at the end belonging to the first participant 1 can also include appropriate means of input, such as a keyboard and a display screen. At the time it enters the networked computer infrastructure, the request 14 is then firstly assigned an identifier 16, which in particular later enables the assignment of the request 14 to the first participant 1, and may also contain characteristic information regarding the content of the request 14. For this purpose, for example, the request 14 can be examined in a standardized manner for specific key terms stored in a catalog database 18 of the networked computer infrastructure 4, and a corresponding key term can be incorporated into the identifier 16.

The request 14 and/or the key terms contained therein are then used for searching in a database 20 of the networked computer infrastructure 4, in which a plurality of video and audio files 22 containing instructions on the various sub-processes are stored. If a match is found between the sub-process 8 relating to the request 14 and a specific audio or video file **22*a* in the database 20 on the basis of the request 14 or the key terms contained therein, this multimedia file 22*a*, which contains the sub-process instruction 24 corresponding to the request 14, is output directly via the data link 12 to the first participant 1**.

However, if the search of the database 20 of the networked computer infrastructure 4 fails to find a multimedia file 22 which corresponds to the sub-process 8 of the request 14 or has the sub-process as its subject, then such a multimedia file is generated in the following manner. A plurality of available participants 26 is registered in a creator database 25 of the networked computer infrastructure 4. The available participants 26 in this case are in the form of audiologists and/or hearing aid acousticians. On the basis of additional expertise data about the available participants 26, which are stored in the creator database 25, a specific second participant 28, who due to their known expertise is optimally suited for the request 14 for the specific sub-process 8, can now be selected.

Once the second participant 28 is selected, a check is made as to whether he/she is able to accept the request 14 at this time, in particular whether a data link 29 exists from the networked computer infrastructure 4 to the second participant 28. If this is the case, the second participant 28 will accept the request 14. If this is not the case, another available participant 26 in the creator database 25 can be specified as the second participant, and their connection to the networked computer infrastructure 4 can be checked.

The second participant 28 then creates a multimedia file 22*b*, which contains the sub-process instruction 24 for the sub-process 8 which was the subject of the request 14 of the first participant 1. The multimedia file 22*b* created in this way is then added to the database 20 and is also output to the first participant 1 via the data link 12 based on the identifier 16. In addition, a notification 30 about a successful creation of the multimedia file 22*b* with the sub-process instruction 24 requested by the first participant 1 can be issued to the first participant 1 in advance. This allows the first participant 1 to download the relevant multimedia file 22*b* from the networked computer infrastructure 4 in a targeted manner, so that the multimedia file 22*b* does not have to be continuously pushed to the first participant 1.

Although the invention has been illustrated and described in detail using the preferred exemplary embodiment, the invention is not limited by this exemplary embodiment. Other variations can be derived from this by the person skilled in the art without departing from the scope of protection of the invention.

The following is a summary list of reference numerals and the corresponding structure used in the above description of the invention:

1 first participant
2 hearing aid
4 networked computer infrastructure
6 user
8 sub-process
10 sub-process
12 data link
14 request
16 identifier
18 catalog database
20 database
22 multimedia file
22*a, b* multimedia file
24 sub-process instruction
25 creator database
26 available participant
28 second participant
29 data link
30 notification

The invention claimed is:

1. A method for transmitting information for adapting a hearing aid, which comprises the steps of:

transmitting a request concerning information of a sub-process of an adaptation and/or a sub-process of an operation of the hearing aid by a first participant to a networked computer infrastructure;

checking the request via the networked computer infrastructure for compatibility with a plurality of stored sub-process instructions:

wherein in an event that compatibility with the request is ascertained, outputting a corresponding sub-process instruction to the first participant; or wherein in an event that no compatibility of any of the stored sub-process instructions with the request is ascertained:

outputting the request to a second participant;

creating a sub-process instruction corresponding to the request with co-operation of the second participant;

outputting the sub-process instruction corresponding to the request to the first participant; and permanently storing the sub-process instruction corresponding to the request in the networked computer infrastructure.

2. The method according to claim 1, wherein:

a plurality of available participants are registered in the networked computer infrastructure; and the second participant is selected from the plurality of available participants.

3. The method according to claim 2, which further comprises generating an identifier which contains characteristic information about the first participant for identifying the first participant, and/or characteristic information regarding a requested sub-process of the adaptation, upon a transmission of the request to the networked computer infrastructure by the first participant.

4. The method according to claim 3, which further comprises selecting the second participant from the plurality of available participants on a basis of characteristic information of the identifier with regard to the requested sub-process of the adaptation.

5. The method according to claim 4, which further comprises outputting the sub-process instruction corresponding to the request to the first participant on a basis of the identifier.

6. The method according to claim 4, wherein, in the event that the sub-process instruction corresponding to the request is generated by the co-operation of the second participant, before the output of the sub-process instruction to the first participant an output notification is transmitted to the first participant by the networked computer infrastructure.

7. The method according to claim 1, wherein the information of the sub-process of the operation, includes information:

about a possible duration of use of the hearing aid; and/or about a replacement or insertion of a battery of the hearing aid; and/or about a selection of a mechanical setup of the hearing aid.

8. The method according to claim 1, wherein the information of the sub-process of the adaptation, includes information:

about a possible progression of a hearing loss; and/or about an adaptation of at least one parameter of the hearing aid to a past progression of a hearing loss.

9. The method according to claim 1, which further comprises outputting the sub-process instruction corresponding to the request as an image file and/or a video file and/or an audio file.

10. A networked computing infrastructure, comprising:

a memory for storing a plurality of sub-process instructions;

a first access point for entering a request and issuing a response;

a second access point for issuing the request and entering a sub-process instruction;

a controller for controlling and processing communication between said first access point, said second access point and said memory, wherein the networked computer infrastructure is configured for carrying out a method for transmitting information for adapting a hearing aid, which comprises the steps of:

transmitting a request concerning information of a sub-process of an adaptation and/or a sub-process of an operation of the hearing aid by a first participant to the networked computer infrastructure;

checking the request by the networked computer infrastructure for compatibility with the plurality of sub-process instructions:

wherein in an event that compatibility with the request is ascertained, outputting a corresponding sub-process instruction to the first participant; or wherein in an event that no compatibility of any of the stored sub-process instructions with the request is ascertained:

outputting the request to a second participant;

creating a sub-process instruction corresponding to the request with co-operation of the second participant;

outputting the sub-process instruction corresponding to the request to the first participant; and permanently storing the sub-process instruction corresponding to the request in said memory.

* * * * *